United States Patent [19]

Allan

[11] Patent Number: 4,688,343

[45] Date of Patent: Aug. 25, 1987

[54] MESSAGE DOME FOR AUTOMOTIVE VEHICLES

[75] Inventor: R. Robert Allan, Vancouver, Canada

[73] Assignee: Ad-Dom International Limited, Vancouver, Canada

[21] Appl. No.: 779,938

[22] Filed: Sep. 25, 1985

[51] Int. Cl.[4] ..... G09F 21/04

[52] U.S. Cl. ..... 40/592; 40/591

[58] Field of Search ..... 40/592, 591, 590, 564, 40/589; 20/10

[56] References Cited

U.S. PATENT DOCUMENTS 2,559,163 7/1951 MacDonald ..... 40/592

3,419,986 1/1969 Naze ..... 40/564

FOREIGN PATENT DOCUMENTS 698669 11/1940 Fed. Rep. of Germany ..... 40/592

528224 of 1955 Italy ..... 40/592

*Primary Examiner*—Robert P. Swiatek

*Assistant Examiner*—J. Hakomaki

*Attorney, Agent, or Firm*—Peter L. Berger

[57] ABSTRACT

A message dome for a roof of an automotive vehicle in which the message portion of the dome is attached to a base and the base is independently attached to the roof. The base includes four corner support sections having a first plurality of bores for providing removable securement of the base to the roof of the automotive vehicle and a second plurality of threaded bores separate from the first plurality of bores; a first plurality of bolts extending through the first plurality of bores to secure the base to the roof; a cover including a third plurality of bores operatively associated with the second plurality of bores when the cover is fit on the base; and a second plurality of bolts extending through the third plurality of bores and threadedly engaged within the second plurality of bores for removably securing the cover to the base, whereby to permit removal of the cover from the base without removing the base from the roof.

11 Claims, 6 Drawing Figures

MESSAGE DOME FOR AUTOMOTIVE VEHICLES

BACKGROUND OF THE INVENTION

The present invention relates generally to message domes for automotive vehicles and, more particularly, to a message dome removably secured to the roof of a taxicab.

It is well known to secure an advertising or message dome to the roof of an automobile, such as a taxicab. Generally, the dome includes a base which sits on and is secured to the roof of the automobile. Specifically, the base includes a peripheral flange having a plurality of holes through which bolts pass for securing the base to the roof of the automobile. A gasket is inserted between the base and the roof, and in combination with a silicone seal, provides a leak-proof seal.

The base includes a holder for securing a light, such as a fluorescent light bulb, thereon, with power for the light being supplied by the generator of the automobile and a switch being provided for turning the light ON and OFF, through suitable wiring.

A cover is secured to the base, and includes various messages thereon which are illuminated when the light is turned ON. For example, the messages may include a "TAXI" message, an "ON CALL" message, an "OFF DUTY" message, advertising messages and the like. The cover includes its own peripheral flange having a plurality of holes which are in alignment with the aforementioned holes in the peripheral flange of the base, whereby the cover is secured to the base by the same bolts used to secure the base to the roof of the automobile.

This arrangement, however, is disadvantageous. Specifically, it is sometimes desirable to remove the cover, for example, to substitute a different cover having different messages thereon, to change or add a light, to fix wiring or the like. In such case, the bolts holding the cover to the base must be removed. Since the same bolts secure the base to the roof, the entire assembly must be removed. Thus, the gasket and silicone seal must be set again, and it is often impossible to use the same gasket again, resulting in additional cost.

OBJECTS AND SUMMARY OF THE INVENTION

Accordingly, it is an object of the present invention to provide a message dome for automotive vehicles which permits removal of the cover from the base without removing the base from the roof of the vehicle.

It is another object of the present invention to provide a message dome for automotive vehicles in which the cover is secured to the base separate from the securement of the base to the roof of the vehicle.

It is still another object of the present invention to provide a message dome for automotive vehicles which permits interchangeability of different covers on the base without removing the base from the roof of the vehicle.

It is yet another object of the present invention to provide a message dome for automotive vehicles which allows for a light to be changed or added without removing the base from the roof of the vehicle.

It is a further object of the present invention to provide a message dome for automotive vehicles that is relatively easy and inexpensive to manufacture and install.

It is a still further object of the present invention to provide a message dome for automotive vehicles that aerodynamically provides minimum wind resistance.

It is a yet further object of the present invention to provide a message dome for automotive vehicles that has a relatively low height, while providing maximum visibility for the messages thereon.

In accordance with an aspect of the present invention, a message dome for a roof of an automotive vehicle, comprises a base including first means for providing removable securement of the base to the roof of the automotive vehicle and second means for providing removable securement of a cover to the base to permit removal of the cover from the base without removing the base from the roof, the second means being separate from the first means; and a cover including third means operatively associated with the second means when said cover is fit on the base for providing such removable securement of the cover to the base.

The above and other objects, features and advantages of the present invention will become readily apparent from the following detailed description thereof which is to be read in connection with the accompanying drawings.

DETAILED DESCRIPTION OF A PREFERRED EMBODIMENT

Figure 1:
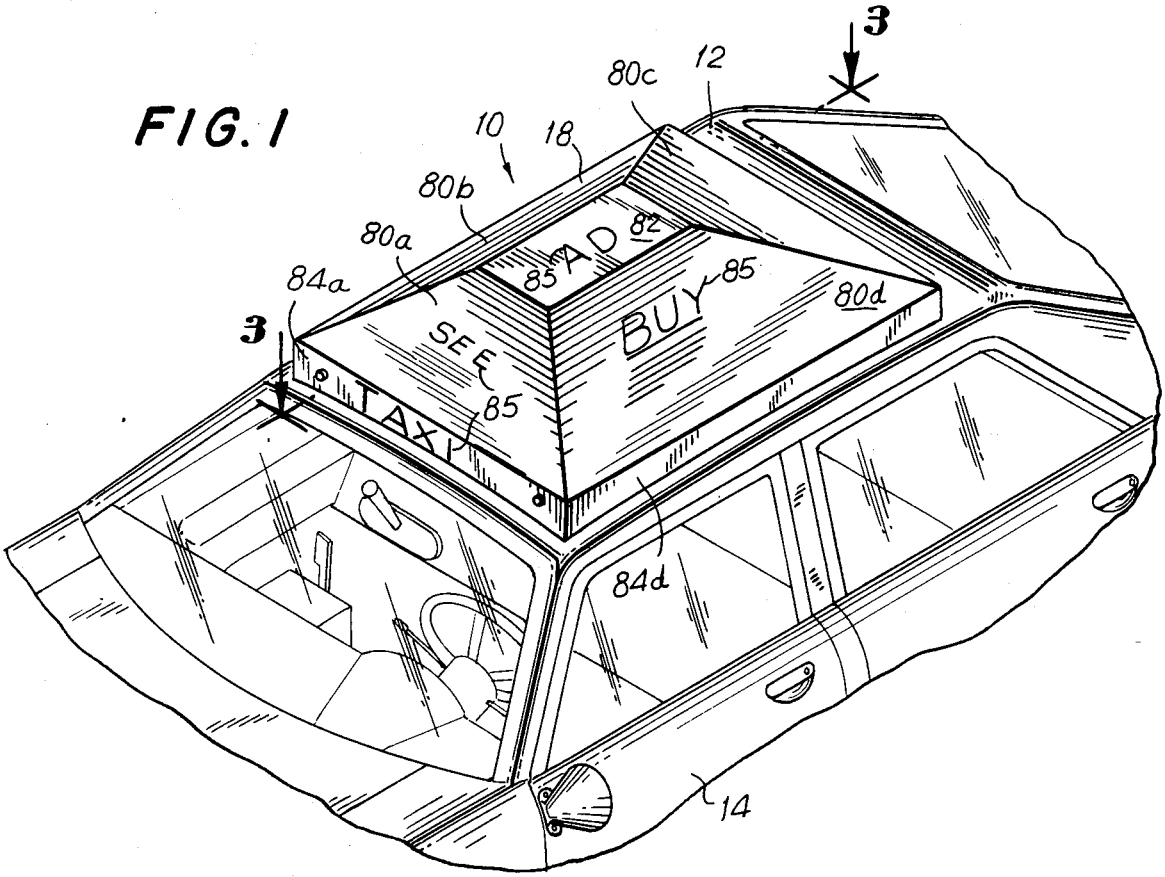
FIG. 1 is a perspective view of a message dome according to the present invention secured to the roof of an automobile.

Referring to the drawings in detail, a message dome 10 according to the present invention, to be mounted on the roof 12 of an automobile 14, such as a taxicab, generally includes a base 16 secured to roof 12 and a cover 18 separately secured to base 16.

Figure 2:
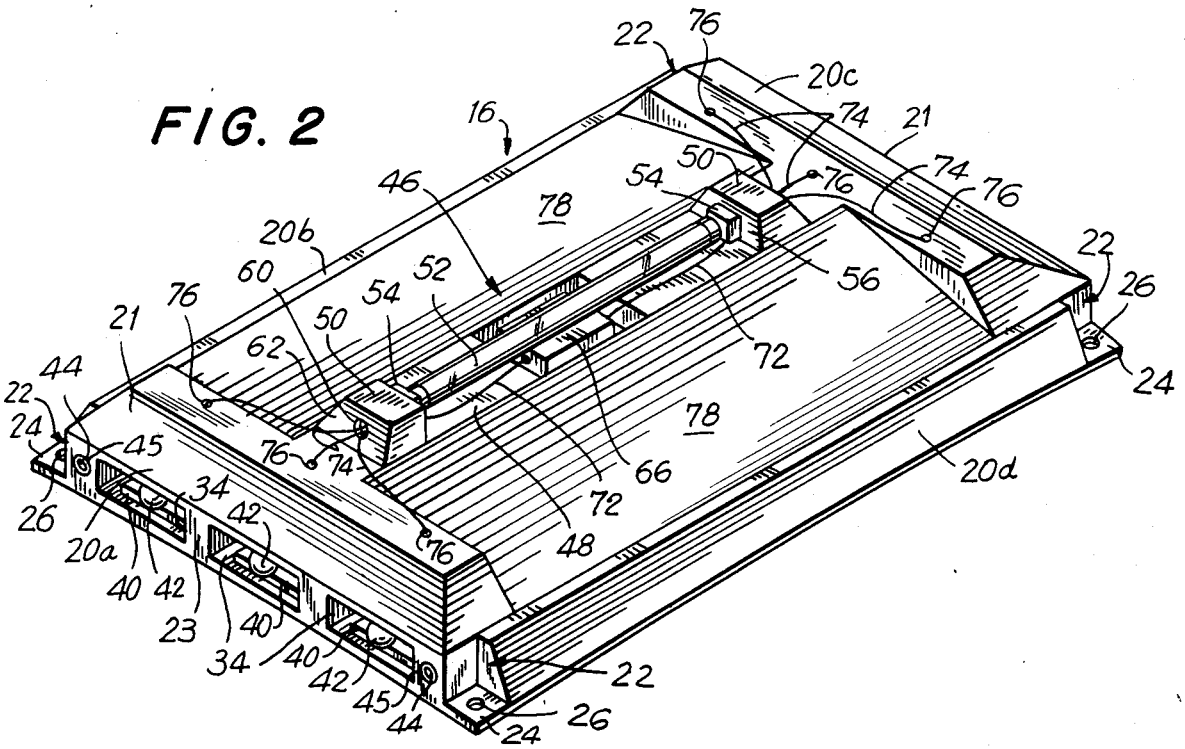
FIG. 2 is perspective view of the base of the message dome of FIG. 1.
Figure 3:
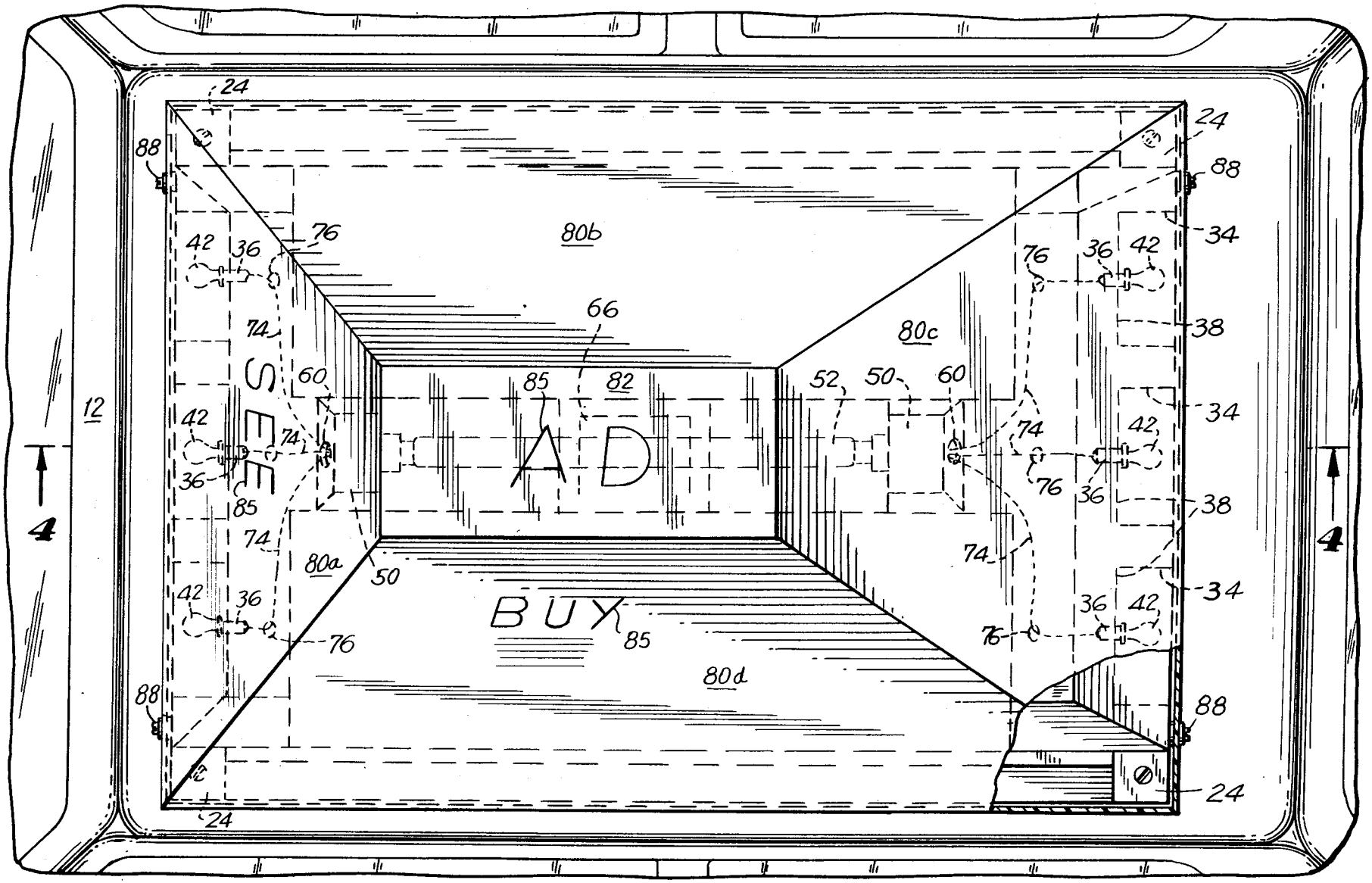
FIG. 3 is a top plan view of the message dome of Fig. 1.
Figure 4:
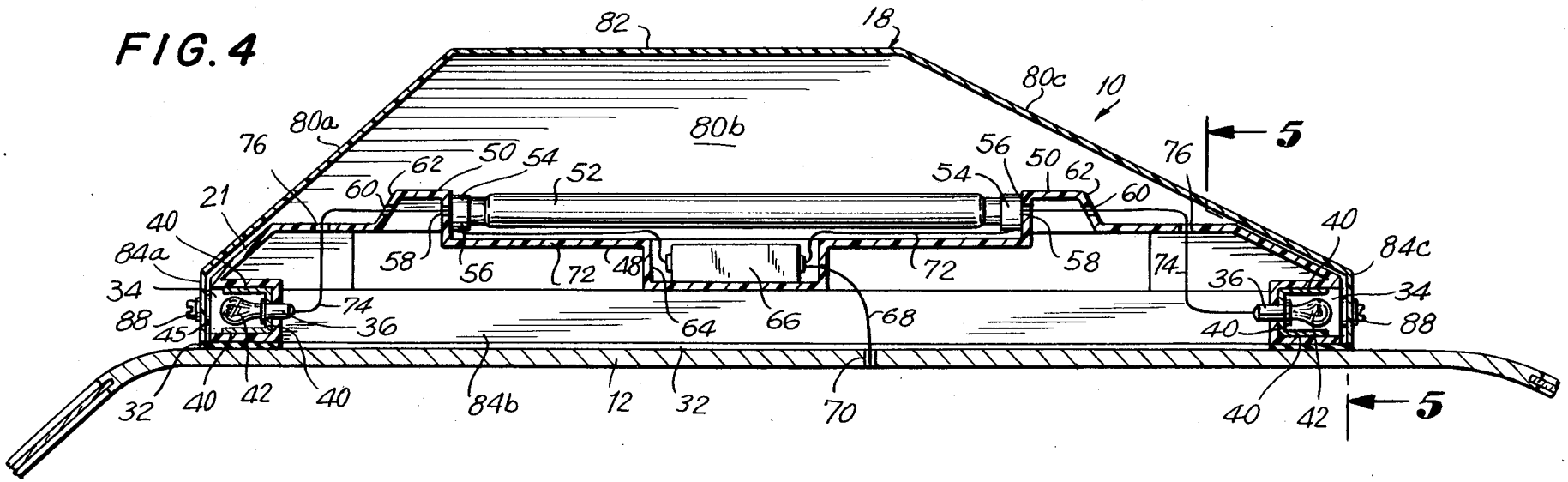
FIG. 4 is a cross-sectional view of the message dome of FIG. 3, taken along line 4—4 thereof.

As shown in FIGS. 2–4, base 16 includes four peripheral walls **20*a*–20*d* which generally define a rectangular configuration. End walls 20*a* and 20*c* each include an upper section 21 and a lower section 23, and lower sections 23 are slightly arcuate at their lower ends to conform to the curvature of roof 12 and thereby provide a better seal thereat. In like manner, side walls 20*b* and 20*d* are slightly tilted or inclined for the same reason. In order to secure base 16 to roof 12, the four corners 22 where walls 20*a*–20*d* meet are cut-away or notched, thereby forming corner support sections 24 of reduced thickness. A through bore 26 is formed in each corner support section 24, and a threaded bore 28 (FIG. 5) is formed in roof 12 in alignment with each corresponding through bore 26, whereby bolts 30 (FIG. 5) passing through corresponding bores 26 and 28 function to secure base 16 to roof 12. Of course, various modifications can readily be made to this arrangement. For example, bolts 30 could be molded as part of base 16, extending downwardly therefrom into corresponding bores 28. In such case, bores 26 would be eliminated. It will be appreciated that a gasket 32 and silicone seal is provided between base 16 and roof 12 which provides a water-impervious seal that prevents water from entering into automobile 14 through roof 12** thereof.

Figure 5:
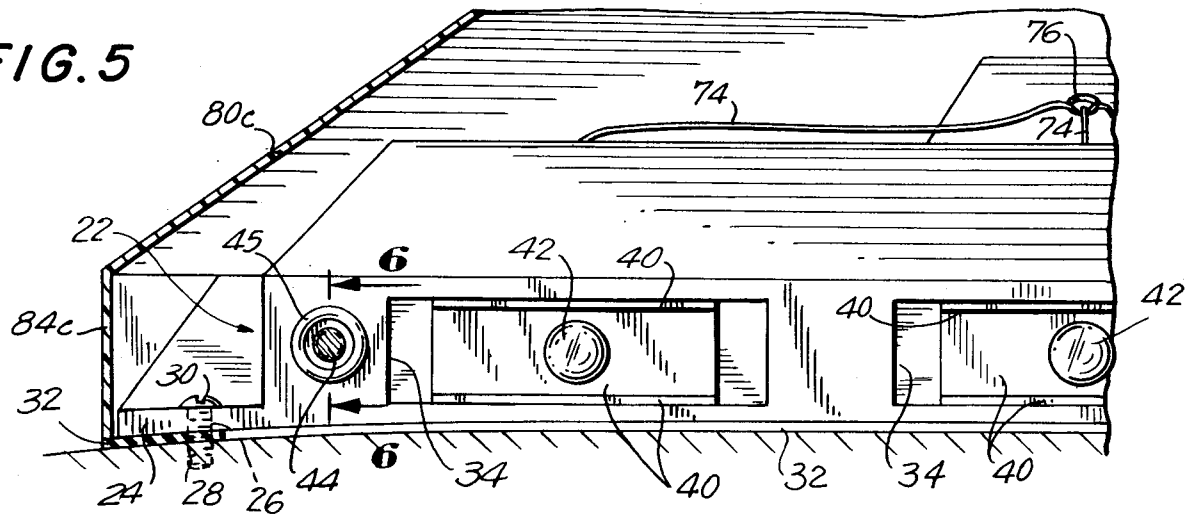
FIG. 5 is a cross-sectional view of a portion of the message dome of FIG. 4, taken along line 5—5 thereof.

As shown in FIGS. 2, 3 and 5, the lower section 23 of each end wall 20*a* and 20*c* is each provided with three recesses 34. A bulb socket 36 is secured to the rear wall 38 of each recess, surrounded by reflector plates 40 within the respective recess 34. A bulb 42 can be fit within each socket 36, the purpose for which will become apparent from the detailed description which follows.

Figure 6:
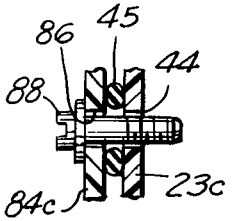
FIG. 6 is a cross-sectional view of a portion of the message dome of FIG. 5, taken along line 6—6 thereof.

In addition, threaded bores 44 are provided on opposite sides of the lower section 23 of each end wall 20*a* and 20*c* for securing a cover to base 16, as shown in FIGS. 2 and 5. A rubber seal 45 (FIGS. 5 and 6) is secured to the outer face of end walls 20*a* and 20*c* in surrounding relation to each threaded bore 44, the reason for which will become apparent from the description which follows. Of course, as with bores 26, bores 44 can be replaced with bolts extending outwardly therefrom, as will be readily apparent from the discussion which follows.

As shown in FIG. 2, a central section 46 of base 16 is surrounded and defined by the four walls 20*a* –20*d*, and includes a narrow, central, longitudinally extending platform 48 having two support posts 50 at opposite ends thereof for supporting a fluorescent light bulb 52, for example a 24 inch 30 watt fluorescent light bulb 52. Specifically, a conventional fluorescent bulb socket 54 is secured to the inner face 56 of each support post 50 for supporting and electrically connecting bulb 52 to a source of power. As shown in FIGS. 2–4, each support post 50 is hollow and includes holes 58 and 60 formed in the inner face 56 and outer face 62 thereof, respectively.

A recess 64 is formed in platform 48, below bulb 52 for holding a ballast 66 for fluorescent light bulb 52. Ballast 66 may be a cold start 12 volt inverter ballast, such as Model 1D12-1-15/20 sold by Iota Engineering Co. of Tucson, AZ. One wire 68 is connected from ballast 66 through a hole 70 in roof 12 to a switch (not shown) in automobile 14 and then to the automobile generator (not shown) thereof, by which power is supplied. Other wires 72 are connected between ballast 66 and fluorescent light bulb 52, and specifically to bulb sockets 54. Fluorescent light bulb 52 may draw 4–6 amps from the automobile generator (not shown) which generates an output of approximately 63–100 amps. Still other wires 74 are connected between bulb sockets 54 and bulb sockets 36 for providing power to bulbs 42. Specifically, each wire 74 extends from a bulb socket 54 (supplied with power from a respective wire 72), through respective holes 58 and 60 and then through a hole 76 in the upper surface of peripheral wall 20*a* or 20*c* to a respective bulb socket 36. As shown in FIG. 2, three holes 76 are provided in the upper surface of upper section 21 of each end wall 20*a* and 20*c*, corresponding to the three bulbs 42 at each end of base 16.

Central section 46 also includes two surfaces 78 downwardly extending from platform 48, one surface being surrouded by walls 20*a*–20*c* and platform 48, and the other surface being surrounded by walls 20*a*, 20*c* and 20*d* and platform 48.

Cover 18 fits over and is secured to base 16. Cover 18 is formed in a truncated pyramid configuration with four inclined sides 80*a*–80*d* which converge to a flat top 82 and which diverge to four vertical sides 84*a*–84*d* respectively. Inclined sides 80*a*–80*d* and end vertical sides 84*a* and 84*c* include various messages 85, as shown in FIGS. 1 and 3, which are lighted by bulbs 42 and 52 when the taxicab is on call. As shown in FIGS. 1, 3 and 4, inclined sides 80*a*–80*d* provide a streamlined configuration which aerodynamically results in minimum wind resistance. In addition, the low height of cover 18 allows for easy access to low level parking facilities and automatic car washes, while achieving maximum exposure for the messages 85 thereon. For example, cover 18 may have a length of 43.5 inches (110.49 cm), a height of 12 inches (30.5 cm), a width of 32 inches (81.28 cm).

End vertical sides 84*a* and 84*c* each include opposite holes or bores 86 which are aligned with threaded bores 44 when cover 18 is fit over base 16. In this manner, bolts 88 extend through holes 86 and rubber seals 45, and are threaded into bores 44 to secure cover 18 to base 16, separately from the securement of base 16 to roof 12. Of course, if bolts are provided in place of threaded bores 44, extending outwardly from end walls 20*a* and 20*c*, at the same positions, these bolts would extend through holes 86 and be secured by nuts secured to the ends thereof. Thus, it is relatively easy to remove cover 18, for example, to substitute a different cover 18 having different messages 85 thereon, to change or add a bulb 42 or 52, to fix wiring or the like. In such case, bolts 88 holding cover 18 to base 16 are removed. Since different bolts 30 secure base 16 to roof 12, the entire assembly need not be removed. Thus, gasket 32 and the silicone seal need not be set again.

The entire assembly, that is, base 16 and cover 18, can be made of a high impact acrylic plastic, and therefore has a weight of approximately 18 lbs.

It will be appreciated that various modifications can be made to the invention by one of ordinary skill in the art. For example, end vertical sides 84*a* and 84*c* can have messages, such as ON CALL, OCCUPIED or the like each associated with one bult 42, with separate switches being provided for these bulbs 42.

Having described a specific preferred embodiment of the invention with reference to the accompanying drawings, it will be appreciated that the present invention is not limited to that precise embodiment, and that various changes and modifications may be made by one of ordinary skill in the art without departing from the spirit and scope of the invention, as defined by the appended claims.

What is claimed is:

1. A message dome for a roof of an automotive vehicle, comprising:

a base, a cover, first securement means to removably secure said base to the roof of said automotive vehicle and second securement means independent of said first securement means to removably secure said cover to said base, said second securement means being independent of said first securement means to permit said cover to be removed from said base without affecting the securement of said base to said roof, said cover fitted onto said base to enclose lights in the message dome and cover said first securement means, said cover and said base being made of molded plastic.

2. A message dome according to claim 1, wherein said first and second securement means comprise threaded members.

3. A message dome according to claim 1; wherein said base further includes means for removably securing at least one light to said base.

4. A message dome according to claim 3; wherein said at least one light includes a fluorescent light bulb, and further comprising a ballast electrically connected to said fluorescent light bulb.

5. A message dome according to claim 4; wherein said means for removably securing at least one light to said base includes two support posts for removably securing said fluorescent light bulb to said base.

6. A message dome according to claim 5; wherein said base further includes recess means positioned below said fluorescent light bulb for supporting said ballast.

7. A message dome according to claim 3; wherein said base includes opposite end walls, and said at least one light includes a plurality of light bulbs mounted in at least one of said opposite end walls.

8. A message dome according to claim 7; wherein at least one end wall includes a plurality of recesses, each including socket means for electrically securing one of said light bulbs therein.

9. A message dome according to claim 8; wherein said base includes at least one reflective plate in each recess.

10. A message dome according to claim 1; further comprising gasket means positioned between said base and said roof for providing a liquid-tight seal for said message dome.

11. A message dome according to claim 1; wherein said cover includes a top and four inclined sides which converge to said top to form a truncated pyramid configuration.

* * * * *